United States Patent [19]

Szkaradek

[11] 3,960,331

[45] June 1, 1976

[54] SANDMILL

[75] Inventor: Edward J. Szkaradek, Santa Ana, Calif.

[73] Assignee: Morehouse, Industries, Inc., Fullerton, Calif.

[22] Filed: Dec. 4, 1974

[21] Appl. No.: 529,409

[52] U.S. Cl. ..... 241/43; 241/46.15; 241/153

[51] Int. Cl.[2] ..... B02C 17/02

[58] Field of Search ..... 241/33, 36, 43, 45, 241/46.02, 46.11, 46.15, 46.17, 153, 65

[56] References Cited

UNITED STATES PATENTS

| | | | |
|---|---|---|---|
| 1,813,086 | 7/1931 | Sahmel | 241/33 |
| 1,937,788 | 12/1933 | Ross | 241/36 |
| 3,423,032 | 1/1969 | Eckert | 241/153 |
| 3,653,702 | 4/1972 | Frimberger | 241/33 X |
| 3,720,379 | 3/1973 | Szeguari | 241/46.15 |
| 3,770,214 | 11/1973 | Gabor | 241/43 X |

*Primary Examiner*—Granville Y. Custer, Jr.
*Attorney, Agent, or Firm*—Knobbe, Martens, Olson, Hubbard & Bear

[57] ABSTRACT

Three sandmill processing vessels are mounted on a central supporting column. The rotors in the sandmill vessels are separately driven by hydraulic motors mounted on the upper portion of the central column. Separate pumps driven by hydraulic motors are mounted below the vessels for pumping the material to be processed through the vessels. An electric motor for driving the hydraulic motors may be remotely positioned to eliminate explosion hazards from electrical sparks. Indicator lights included in safety control circuitry for the electric motor are energized to indicate the malfunction if the motor is automatically deenergized.

3 Claims, 6 Drawing Figures

SANDMILL

This invention relates to mixing or grinding apparatus such as sandmills which mill to a high degree of fineness particles within liquids. More specifically, the invention relates to an improved arrangement of supporting and utilizing such sandmills and to an improved means for indicating improper operating conditions.

Sandmilling is a proven, practical, low cost, continuous, high production method of dispersing particles in liquids to produce smooth uniform finely dispersed products. One good example of this being the dispersement of pigment agglomerates in film forming materials. The process is applicable to the manufacture of practically all types of critical specification finishes, including automotive, industrial, architectural and house paints, as well as to a wide variety of inks, dye stuffs, paper coatings, chemicals, magnetic tape coatings, insecticides and other materials where milling to a high degree of fineness is required. In short, sandmilling is an established, widely used method of processing a large variety of liquids.

In the typical sandmilling process, the material or slurry to be treated is introduced at the bottom of a processing chamber and pumped upwardly through a grinding media, which is often referred to as sand, although it is normally a small diameter manufactured grit rather than sand. Rotors positioned within the vessel forming the processing chamber grind the slurry as it is pumped through the media.

Typically, sandmills have been manufactured by mounting a single sandmill vessel on a supporting column, which the user then positions in his production facility in the desired location. A manufacturer or processer who utilizes a sandmill will often have more than one type of slurry which he would like to treat with the sandmill. For example, a paint manufacturer might desire to utilize a sandmill to process paints in several basic colors. Quite often, however, such production runs may not continue for very long. The cost of a sandmill is such that it is usually not practical to simply buy another sandmill for each different slurry that the user may desire to have processed. Instead, the user will typically clean the vessel and the pump and other piping through which the material passes before processing the next substance. The cleaning operation takes considerable time, such as a half day or more, and thus results in a considerable expense for labor and lost production time.

One partial solution to this problem has been to utilize so-called removable vessels. Thus, when a particular production run is finished, the vessel would be removed and stored, without being completely cleaned, until the same type of material is to be processed again. Such approach has some advantage in that the remaining substantial portion of the sandmill apparatus is kept in continuous use and the user only has to maintain an inventory of vessels. Thus, this approach is perhaps less expensive than simply purchasing a completely new sandmill. On the other hand, there is still some considerable effort and expense in removing a vessel, transferring it to a storage area, and installing a new vessel. Plus, unless the apparatus for pumping the slurry through the vessel is also removed, which would add further expense, it is still necessary to thoroughly clean the pump and the piping connecting the pump to the vessel.

With either of the foregoing approaches, sufficient floor space must be provided for convenient operation and servicing of the apparatus including the replacing of vessels. Also, with the removable vessel approach, there is the added expense of the appropriate storage space for vessels not being used.

In view of the foregoing, it has been recognized that a need exists for a system which provides more efficient utilization of the combined resources necessary for the purchasing, maintenance and operation of sandmilling apparatus, including in operation the expense of the required floor space. In accordance with the present invention, two or more vessels, the preferred number being three, are mounted, clustered about a single supporting column with means for separately operating each of the sandmills. With three vessels so mounted, the capacity of the apparatus is tripled, but yet the cost of the apparatus is only about double that of a single sandmill. Further, the space requirements for operation of the three vessel unit is much less than that required for three single vessel sandmills. In fact, the costs are such that in many operations it is practical to utilize a vessel for a single processing operation even through the operation may not be continuous, but instead may be frequently interrupted. In other words, the cost of the apparatus and the space it requires is such that it is more practical to let a portion of the apparatus sit idle periodically than it is to clean thoroughly the system or to remove a vessel and store it elsewhere. In effect, it is a sandmill with spare vessels that when not in use are stored right where they will be used the next time.

Another significant advantage of this cluster concept concerns the means for driving the rotors in the sandmill vessels. With a conventional sandmill having a single vessel and a single drive mechanism, it is most economical to use an electric motor even though for many materials being processed this necessitates a completely sealed system to minimize explosion dangers that exist because of the electric motor. Hydraulic motors avoid the electrical hazard, but normally it is not practical to utilize hydraulic power for a single sandmill. However, with the present system it is practical to utilize a separate hydraulic motor to drive each of the sandmill vessels, because a single electric motor driving a pump can be positioned remote from the combustible vapors that may be present at the sandmilling apparatus, with the hydraulic power then being transmitted to the hydraulic motors mounted in the sandmill. This, of course, eliminates the need for a sealed enclosure at the sandmill. The cost for the power requirements to drive three sandmills is much less than triple the cost for that now required to power single sandmills. Plus, the operation is safer.

A similar advantage arises in connection with the means used to pump the slurry through the sandmill vessel. Single vessel units usually employ a slurry pump driven by an electric motor in a sealed compartment. The three vessel approach can utilize a hydraulic motor by each vessel to drive a slurry pump, with the pressurized fluid for the hydraulic motors provided by an electric motor driven pump located away from the sandmill. This, too, eliminates a sealed compartment.

An advantage of the hydraulic motor arrangements is that the capability for adjustment of the rotational speed of the sandmill rotors or the slurry pump is easily and practically available whereas variable speed electric motor capability is a considerable extra expense. Providing the optimum rotor speed and slurry pump speed for a particular processing operation is quite desirable.

Another advantage of the cluster arrangement is that if desired, the material being processed can be conveniently pumped through two or three of the vessels in series by connecting the outlet of a vessel to the inlet of an adjacent vessel. This can be more economical than pumping batches of the material into a storage container and then recycling in batches.

In operating the electric motor which drives the hydraulic pumps, it is desirable that safety means be provided to stop the motor if certain unsafe operating conditions arise. As a further method to lower the cost of operation, means are provided to indicate the unsafe condition which caused the motor to be deenergized. This conveniently enables maintenance personnel to know what caused the malfunction.

For a detailed description of the preferred embodiment of the invention, refer now to the following drawings, in which.

Figure 1:
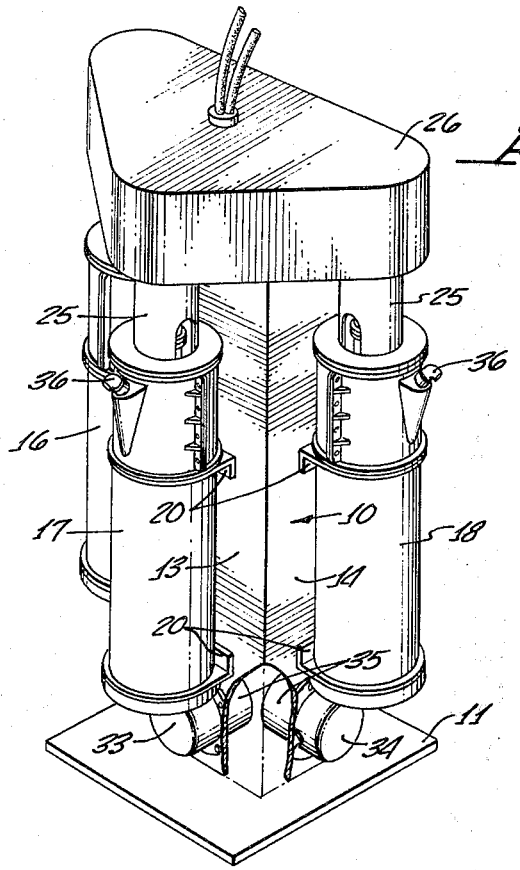
FIG. 1 is a perspective view of the sandmill apparatus of the invention.
Figure 2:
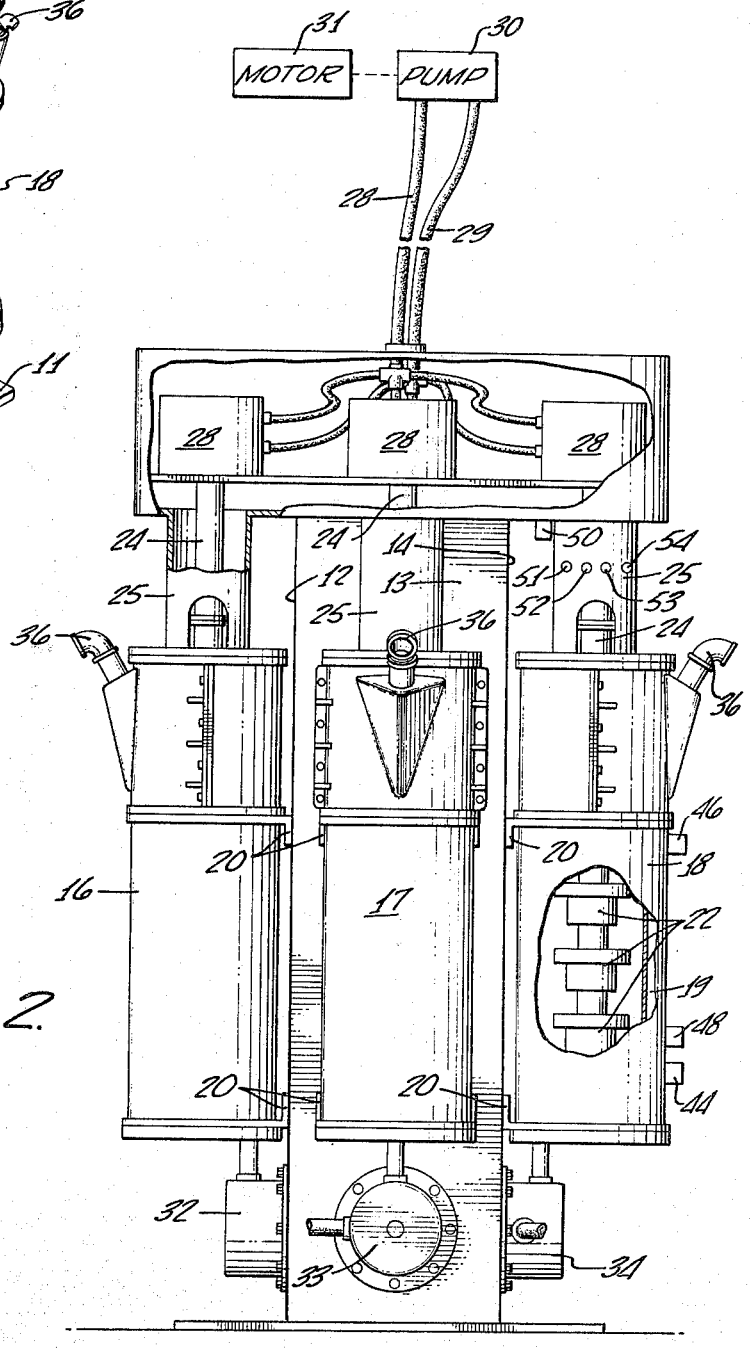
FIG. 2 is a front elevational view of the apparatus of FIG. 1.

Referring now to FIGS. 1 and 2, the sandmill apparatus shown includes a central support column or pedestal 10 mounted on a platform or base 11. The column 10 has a rectangular cross-section with left front and right sides 12, 13 and 14. Sandmill vessels 16, 17 and 18 are respectively mounted on the sides 12, 13 and 14 of the supporting column. More specifically, the vessels are supported by a pair of spaced brackets 20 attached to the supporting column. The vessels have spaced double walls which form a cooling chamber 19 for water or other suitable coolant which maintain the vessel at a desired temperature. Within each vessel there is provided a series of rotors, some of which are shown at 22 for the vessel 18. The rotors are attached to a shaft 24 which extends vertically at the upper end of the vessel, through a shaft housing 25 and into a motor housing 26 where it is driven by a hydraulic motor 28. Note that a separate hydraulic motor is provided for each of the sandmill vessels. The motors are driven by hydraulic fluid transmitted by the conduits 28 and 29 to and from a remotely positioned, schematically shown hydraulic pump 30 which is driven by a schematically shown electric motor 31 of suitable size.

Each cylindrical vessel is also provided with a separate pump 32, 33 and 34 located beneath the vessel supported by the central housing. Like the rotors 22, the pumps 32, 33 and 34 are driven by hydraulic motors 35 which are powered by hydraulic pressure from a remote location, thus avoiding the need to have a sealed enclosure for an electric motor, as is common for single vessel units. The motors 35 and the motors 28 can conveniently be powered from the same source.

The controls for the hydraulic motors are not shown but they may be conveniently mounted on the central column either adjacent the vessels or on the back side of the column. Also, the back side of the column provides easy access to the components within.

In operation of the sandmills, each processor is filled with a grinding media, and the material to be processed is pumped upwardly through the vessel by the pumps 32–34 and outwardly through the pipe 36 at the upper end of the vessel. The rotors are, of course, rotating during this operation so that the pigments or other particles in the slurry being pumped through the vessels are finely ground and dispersed.

Figure 3:
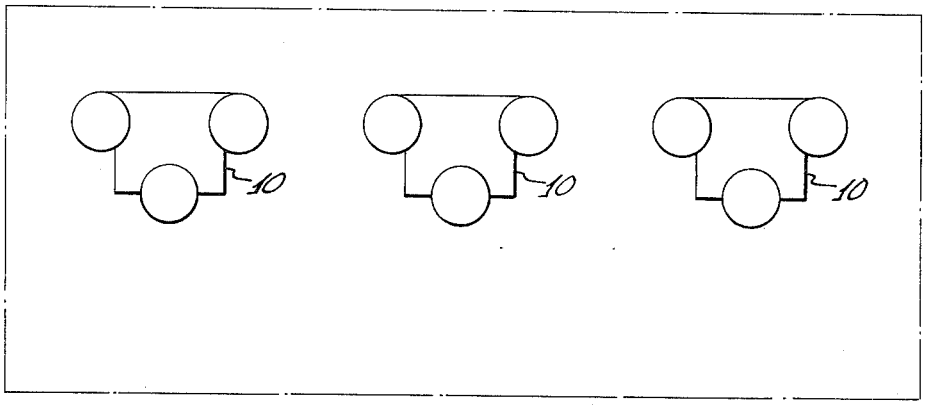
FIG. 3 is a schematic illustration of the space required for three of the units of the type shown in FIG. 1 which provide nine vessels.

The many advantages of this practical arrangement employing three vessels on a single stand have been outlined above. The space saving with these vessel clusters, as opposed to the single vessel per support, prior art arrangement, may be better appreciated by reference to FIGS. 3 and 4. FIG. 3 shows a schematic layout of three of the structures of FIGS. 1 and 2 as they might be arranged on a user's floor space. As can be seen, this represents nine processing vessels. The space requirement for three such units providing nine typically sized vessels is approximately 200 square feet.

Figure 4:
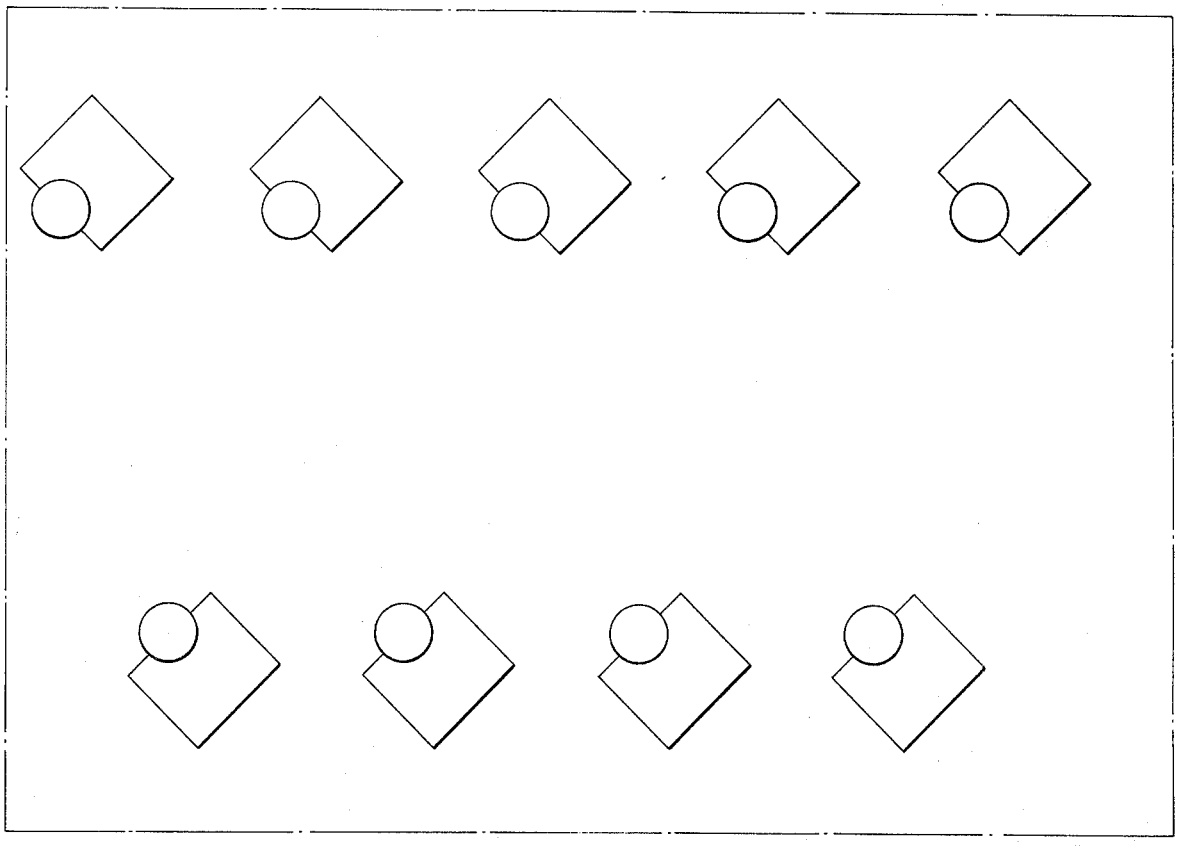
FIG. 4 is a schematic showing of the space required to position nine sandmill vessels.

By contrast, the arrangement in FIG. 4 schematically illustrates nine of the single vessel per central column units arranged with the same necessary clearance between units. That is, there is approximately 2 feet between each unit in both arrangements and both arrangements have a four foot aisle alongside a row of machines. The space requirement for the arrangement of FIG. 4 is 550 square feet. Thus, it can be seen that the space requirement for the old arrangement is almost triple that of the new arrangement. Or stated differently, a single unit in the old arrangement requires almost as much room as a unit in FIG. 3 having three vessels. Thus, the space saving advantage of the present invention is readily apparent.

Figure 5:
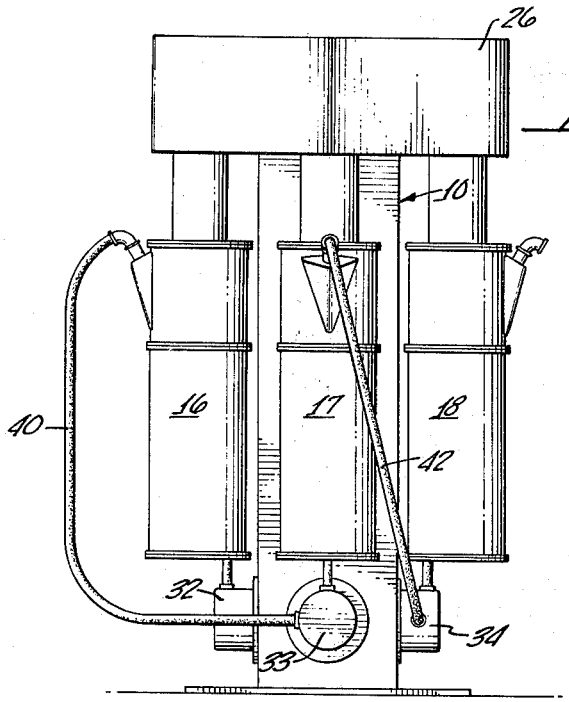
FIG. 5 is a schematic showing of three vessels connected in series.

In some situtations it is desirable to pump the slurry or product being processed in series through two or more vessels to obtain exceptional fineness of the product. This can be very conveniently accomplished with the vessels mounted on a control column. FIG. 5 schematically illustrates a hose 40 connecting the outlet 36 of the vessel 16 to the input of the vessel 17 and the output of vessel 17 connected by a hose 42 to the input of the vessel 18. The input connections to vessels 17 and 18 are through the slurry pumps 33 and 34 in series with the pump 32; however, if additional pumping force is not needed, the pumps 33 and 34 can be bypassed.

There are certain situations in which the sandmill operation should be interrupted because of safety or improper processing of the product. For example, the temperature of the cooling water in the chamber 19 and the temperature of the product in the vessels should not exceed certain levels. Thus for each vessel a sensor 44 shown schematically in FIGS. 2 and 6 is provided to sense the temperature of the cooling liquid and another sensor 46 senses the temperature in the vessel.

The seals (not shown) on the rotor shafts 24 where the shafts enter the vessels are balanced pressure seals. The coolant in the chamber 19 is pressurized to balance the pressure within the vessel. A sensor 48 is employed to sense the coolant pressure to insure that the pressure is not out of the desired range.

Another safety feature is that a mechanical interlock 50 is positioned to sense when the motor housing 26 is closed and prevent operation when the housing 26 is open. Other safety sensors may also be included if desired.

Figure 6:
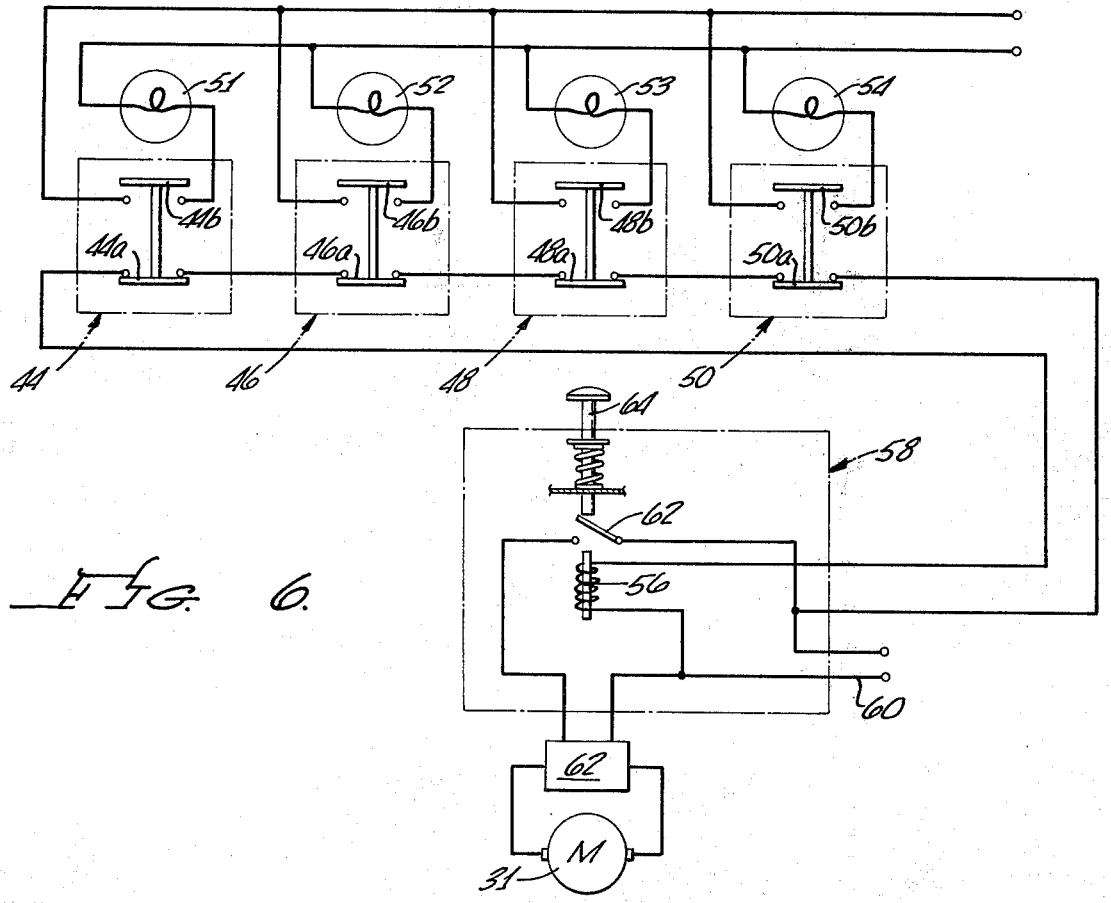
FIG. 6 is a circuit diagram illustrating means for indicating unsafe operation.

As shown in FIG. 6 each of the sensors 44 through 50 is conveniently constructed as a double pole switch having a first pole 44*a* through 50*a* with normally closed contacts and a second pole 44*b* through 50*b* with normally open contacts. Each of the poles 44*b* through 50*b* are connected in series between a power source and an individual indicator light 51 through 54. Thus, for example, if the temperature of the product in the vessel exceeds a predetermined level, the sensor 46 will close the pole 46b to illuminate the indicator light 52. Similarly, each of the indicator lights 51 through 54 is individually illuminated by actuation of the sensors 44 through 50 to notify operating personnel regarding the particular malfunction which is causing interruption of equipment operation.

Each of the normally closed contacts 44a through 50a is serially connected to the coil 56 of a resetting relay 58 and the main power source for the motor 31 and relay 58 which is applied to the relay 58 at 60. The motor 31 is connected to the power source at 60 through a single pole, single throw, normally open switch contact 62. This switch contact 62 may be energized to the closed position by a spring returned reset button 64. As is common with reset relays, the energization of the coil 56 by the power supply at 60 through the series connected poles 44*a* through 50*a* is insufficient by itself to close the switch contacts 62 but is sufficient once the contacts 62 are closed by the reset button 64 to maintain the switch contact 62 in a closed position. Thus, so long as each of the poles 44a through 50*a* are closed, the switch contact 62 will remain closed to enable operation of the motor 31. When one of the sensors responds to a malfunction, the open circuit at one of the poles 44*a* through 50*a* will deenergize the coil 56, opening the contacts 62 to deenergize the motor 31. If the malfunction ceases as, for example, by the eventual cooling of the product, the sensor 46 will close the switch contacts 46*a*. The motor 31 will not be energized, however, until the reset button 64 is again depressed, so that fault diagnosis may be accomplished before the equipment is automatically started. As is customary, the motor 31 is connected to the power source 60 through a starting transformer 62 which may include a power switch for starting and running the motor 31.

The indicators 51–54 can be physically positioned at convenient locations on the sandmill to be visible by operating and maintenance personnel. The advantage of this arrangement is that maintenance personnel will quickly know from the indicator lights what caused the unit to stop. Once the condition has been corrected, the electric motor is once more energized and the energized indicator light is deenergized.

What is claimed is:

1. Sandmilling apparatus comprising:

a central support column having a hollow interior;

a plurality of separate, cylindrical sandmill processing vessels each having an interior cylindrical wall and each separately supported respectively on one of a plurality of sides of the exterior of the column spaced around the column with one side having no vessel thereon and being available for access to the hollow interior of the column;

each said vessel having an inlet and an outlet;

means for continuously pumping material to be processed in the inlet of each vessel, through the vessel, and out the outlet;

a rotor in each of said vessels with a drive shaft extending outwardly from the vessel; and means supported on said column for independently driving each of said rotor drive shafts.

2. The apparatus of claim 1 wherein the means for driving each of the rotor drive shafts is a separate hydraulic motor for each unit mounted on the upper portion of said support column, said hydraulic motors being adapted to be connected to a source of pressurized fluid remote from said apparatus.

3. The apparatus of claim 1 wherein there are three sandmill vessels respectively supported on three sides of the support column with a fourth side of the support column being available for access to the interior of the column.

* * * * *